US005860172A

United States Patent [19]

Pfeiffer

[11] Patent Number: 5,860,172

[45] Date of Patent: Jan. 19, 1999

[54] SINK CONSTRUCTION

[76] Inventor: Holm Pfeiffer, 21 Emmeliusstr., Asslar, Germany, 35614

[21] Appl. No.: 861,090

[22] Filed: May 21, 1997

[51] Int. Cl.[6] ..... E03C 1/18

[52] U.S. Cl. ..... 4/631; 4/619; 312/228

[58] Field of Search ..... 4/619, 631–637; 312/228; 156/304.5

[56] References Cited

U.S. PATENT DOCUMENTS

| | | | |
|---|---|---|---|
| 275,122 | 4/1883 | Blackwood, Jr. | 4/631 |
| 2,475,112 | 6/1949 | Stanitz | 4/635 |
| 3,813,706 | 6/1974 | Williams | 4/631 |
| 4,374,695 | 2/1983 | Ikeda et al | 4/619 |
| 5,016,297 | 5/1991 | Sauter et al. | 4/619 |
| 5,581,957 | 12/1996 | Egger, Jr. et al. | 4/631 |

FOREIGN PATENT DOCUMENTS

| | | | |
|---|---|---|---|
| 103698 | 4/1938 | Australia | 4/634 |
| 2900833 | 7/1980 | Germany | 4/632 |
| DM033437 | 7/1995 | Hague Agreement . | |
| 8201-555 | 11/1983 | Netherlands | 312/228 |

*Primary Examiner*—Charles R. Eloshway
*Attorney, Agent, or Firm*—Jacobson, Price, Holman & Stern, PLLC

[57] ABSTRACT

A sink construction for use in a kitchen, bathroom or any other facility in which an attractive sink would be normally installed. The sink construction includes a sink bowl bottom combined with a vertical wall, with the vertical wall and counter top preferably constructed of the same material. The vertical wall includes at least one seam with connection including a tongue and a groove. The vertical wall is connected to the counter top assisted by laterally extending support members beneath the counter top. The sink bowl is secured within a downwardly and inwardly opening recess on the lower inner edge of the vertical wall by a filler material that engages a lateral flange at the top of the sink bowl.

20 Claims, 3 Drawing Sheets

SINK CONSTRUCTION

BACKGROUND OF THE INVENTION

1. Field of the Invention

The present invention relates to utilitarian and aesthetic sink constructions for use in a kitchen, bathroom or any other facility in which an attractive sink would be normally installed. The sink construction includes a stainless steel bottom combined with a counter top and vertical wall constructed from a polymer based solid surface sheet material. More particularly, the invention relates to the manner in which the components of the solid surface sheet material are connected to each other and the stainless steel bottom is secured to the solid surface sheet material wall in order to provide a secure mounting and a positive seal, together with a very attractive appearance. The present invention is an improvement over the sink construction disclosed in International Industrial Design Reg. No. DM 033,437, dated Jul. 3, 1995, and published in the International Design Bulletin (Issue No. July 1995).

2. Description of the Prior Art

Sink constructions including a rigid bowl of stainless steel, porcelain and various other materials are well known and are normally installed in a counter top constructed of solid surface sheet material in order to support the sink from the solid surface sheet material and also to seal the periphery of the bowl or bottom of the sink to the solid sheet material. FIGS. 4 and 5 in the accompanying drawings, illustrate the prior art sink construction disclosed in the aforesaid International Industrial Design Reg. No. DM 033,437, dated Jul. 3, 1995, and published in the International Design Bulletin (Issue No. July 1995). This prior art sink construction includes a stainless steel bowl secured to the bottom edge of a vertical wall constructed of polymer based solid surface sheet material, in particular a thermoplastic sheet material available from DuPont under the name CORIAN®.

The periphery of the bowl in this prior art construction is provided with an outwardly extending horizontal flange and an upstanding vertical flange at its outer edge for engaging the bottom edge and lower outer surface of the vertical wall. The vertical wall comprises two segments interconnected by butt type vertical joints adheringly sealed together to form the vertical wall. A sealant and adhesive material is disposed between the contacting surfaces of the flanges on the sink bowl and the abutting contacting vertical edge and horizontal bottom surfaces of the vertical wall components in order to seal and connect the bowl to the bottom of the vertical wall.

The prior art does not disclose, however, a sink structure having the desired strength and sealing characteristics of the present invention. More specifically, the prior art does not include a sink structure in which the components of a polymer based vertical wall are interconnected by a tongue and groove joint combined with an appropriate adhesive and sealant. The prior art also does not disclose a connection between a stainless steel, or other type metal, bottom or bowl and the lower edge of a polymer based vertical wall of the sink construction which ensures an anchored interconnection and seal.

SUMMARY OF THE INVENTION

The sink construction of the present invention includes the mounting of a sink having a bottom bowl and an upwardly curved peripheral wall in supported relation to a horizontally disposed counter top constructed from a polymer based solid surface sheet material by the use of a vertical peripheral wall preferably made from the same polymer sheet material as the counter top. The vertical wall has its upper edge connected with the horizontal counter top of sheet material and its lower edge connected to an outwardly extending flange on the upper edge of the periphery of the bottom bowl. The bottom bowl is preferably constructed of stainless steel, or other formed or molded material. The vertical wall component is preferably constructed in two components each extending approximately one half of the periphery of the bottom bowl and one half of the periphery of the opening in the horizontal counter top of sheet material. The vertical juncture between the two components of the vertical wall are mechanically connected and sealed in relation to each other by a tongue and groove connection and an appropriate adhesive and sealant material.

The periphery of the sink bowl is provided with an outwardly extending generally horizontal flange at its upper edge. The lower edge of the vertical wall is provided with a peripheral recess around its inner edge. The recess is generally rectangular in cross-section with an upper wall and an outer wall. The recess receives the flange on the bowl with an adhesive and sealant between the flange on the bowl and the upper or horizontal wall of the recess. The remainder of the recess below the flange on the bowl is filled with a sealant and adhesive. The outer wall of the recess is sloped or inclined downwardly and inwardly toward the bowl at an angle to provide a wedge-shaped configuration between the outer wall of the recess and the upper vertical side wall of the bowl. By this construction, the inward slope of the outer wall of the recess securely anchors the sealant and adhesive material which fills the recess below the flange on the bowl thereby providing an effective mechanical connection between the sealant and adhesive material, the bowl flange and the recess. In this manner, a secure mounting for the bowl from the vertical wall and an effective seal between the bowl and the vertical wall are achieved.

Accordingly, it is an object of the present invention to provide a sink construction including a multi-piece vertical wall fabricated from polymer based solid surface sheet material with vertical junctions between the vertical wall components formed by a tongue and groove mechanical connection which receives a sealant and adhesive to effectively connect the vertical wall components and effectively seal the vertical wall components along their vertical junctions.

Another object of the invention is to provide a sink construction in which the bottom edge of the vertical wall includes an inner peripheral recess which opens downwardly and inwardly for receiving, retaining and sealing therein an outwardly, horizontally extending flange on the upper peripheral edge of the sink bottom bowl.

A further object of the invention is to provide a sink construction in accordance with the preceding objects in which the recess configuration at the bottom of the vertical wall more effectively secures the bowl flange to the wall bottom edge by filling the recess below the flange with adhesive and sealant material to thereby anchor and seal the flange in the recess.

Still another object of the present invention is to provide a sink construction having a vertical wall fabricated from polymer based solid surface sheet material and a sink bottom constructed of stainless steel, or other differentiating metal or distinctive material, which is securely fastened to the bottom edge of the vertical wall and which provides a strong seal against leakage of water or other liquids in the sink.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
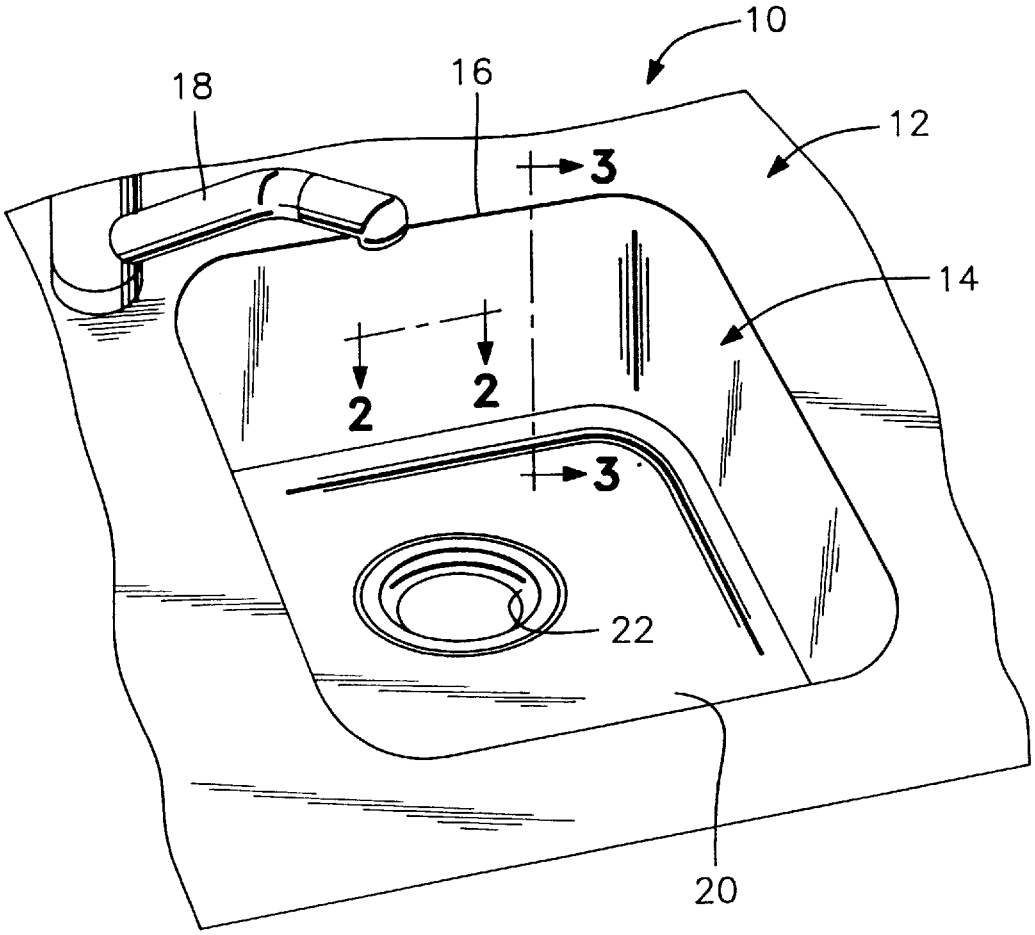
FIG. 1 is a perspective view of a sink incorporating the structure of the present invention.

In describing the preferred embodiments of the present invention as illustrated in the drawings, specific terminology will be resorted to for the sake of clarity. However, the invention is not intended to be limited to the specific embodiment illustrated in the drawings and the terminology selected; it being understood that each specific term includes all technical equivalents which operate in a similar manner to accomplish a similar purpose.

Figure 2:
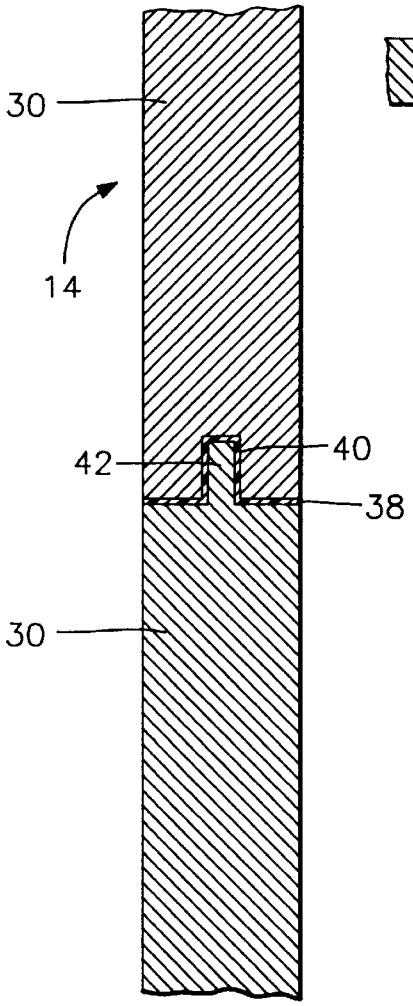
FIG. 2 is a horizontal sectional view on an enlarged scale taken along section line 2—2 on FIG. 1 illustrating the tongue and groove connection between vertical wall components of the sink construction.
Figure 3:
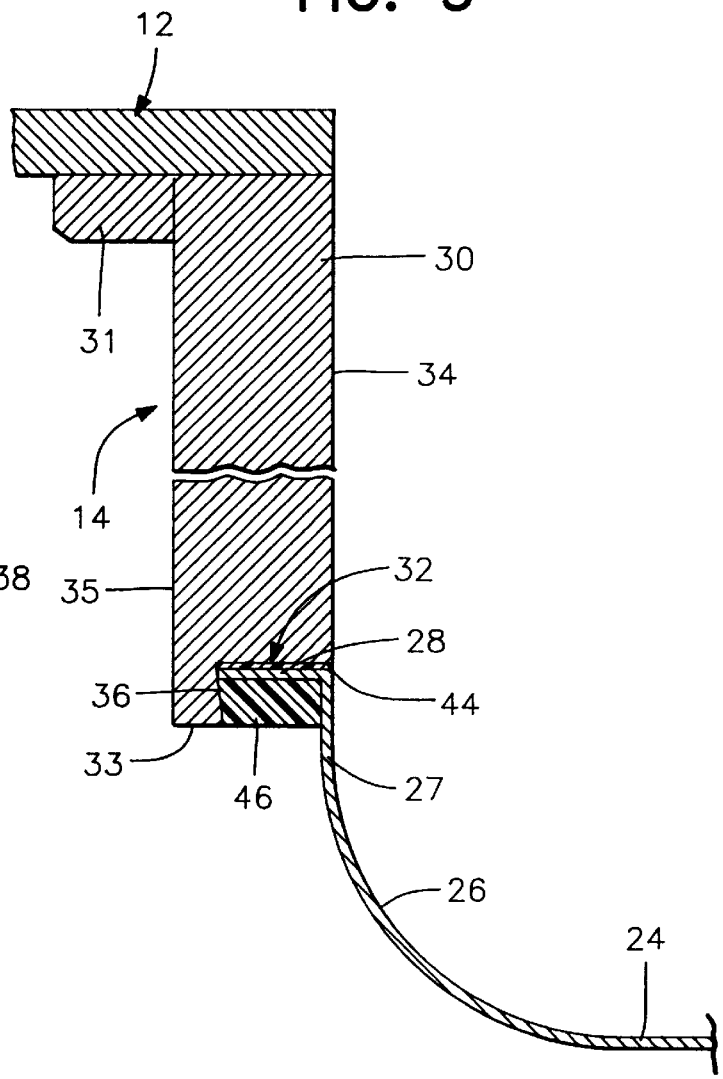
FIG. 3 is a vertical sectional view on an enlarged scale taken along section line 3—3 on FIG. 1 illustrating the connection between the sink bowl and the vertical wall of the sink construction and the reinforced connection between the vertical wall and the counter top.

Referring to FIGS. 1–3, a preferred embodiment of the sink construction of the present invention is generally designated by reference numeral 10 and includes a horizontally disposed sheet material counter top in the form of a panel 12 having a vertical wall 14 connected thereto at the periphery of an opening 16. A faucet 18 and associated control structure is provided in association with the sink in a well known manner. At the lower end of the vertical wall 14 is a sink bottom or bowl 20 having a drain structure 22 incorporated therein in a conventional and well known manner. The present invention involves the construction of the vertical wall 14, the connection between the counter top 12 and wall 14 and the connection between the lower end of the vertical wall 14 and the sink bowl or bottom 20, especially for the particular materials employed for the present invention to provide a strong and well sealed sink structure having a pleasing aesthetic appearance.

In this regard, the vertical wall 14 is preferably constructed of the same polymer based solid surface sheet material as the counter top 12; whereas, the sink bowl or bottom 20 is preferably constructed of a contrasting material such as stainless steel, copper, porcelain, or other rust resistant metals or other contrasting materials, such as molded plastic. As shown in FIG. 2, the vertical wall 14 preferably includes two vertical wall components 30 joined along two vertical joints or seams 38. However, wall 14 may include more than two components 30, and may even be formed as a single component. The seam edge surfaces are provided with a groove 40 in one edge surface and a tongue or feather 42 on the opposite edge surface so that the tongue 42 is telescopically received within the groove 40. The tongue 42 and groove 40 provide an increased static and mechanical stability and also increase the adhesion area by approximately 75% by providing an additional adhesion area along the surfaces of the tongue 42 and the groove 40. The adhesion areas between the wall components 30 are glued together with an adhesion and sealant material in the form of a two component adhesive.

The counter top panel and the vertical wall components are preferably fabricated from solid CORIAN® sheet material from DuPont, or other similar thermoplastic or other polymer sheet products. The CORIAN® material can be provided in various available designs and colors with various available surface appearance characteristics so that the sinks including the vertical wall components are inconspicuously integrated into the counter top or working surface of the same material.

As illustrated in FIG. 3, the sink bowl 20 includes a bottom wall 24 having an upwardly curved peripheral wall 26 which extends vertically as at 27 and terminates in an outwardly extending horizontally disposed flange 28. The vertical wall 14 is provided with a generally rectangular recess 32 in the bottom edge thereof with the recess extending from the inner surface 34 of the vertical wall 14 toward the outer surface 35. However, the recess 32 terminates inwardly of the outer surface 35 in an inclined downwardly extending outer wall 36 which inclines slightly downwardly and inwardly toward the curved portion 26 of the bottom bowl 20. The degree of inward taper of outer wall 36 of recess 32 is preferably about 7°, although this may vary somewhat between as low as 5° to as much as 30°, and even more, depending on the size of the recess, the materials employed, the depth to which the recess is filled and other factors. The width of the recess 32 along its upper wall from the inner surface 34 of the vertical wall 14 toward the outer surface of the wall 14 is preferably about the same dimension as the flange 28.

A suitable adhesive and sealant material 44 is oriented between the top surface of the flange 28 and the upper wall of the recess 32 to sealingly adhere the bowl 24 to the vertical wall 14. The remainder of the recess 32, below the flange 28 and between the outer recess wall 36 and the upper vertical edge 27 of the bowl wall 26 is filled with a self-leveling silicone 46. The silicone in the recess 32 interacts with the slope or incline on the outer wall 36 of the recess 32 to lock the components together in a secure and positive sealing arrangement. The polymerized silicone acts as a stamped rubber seal between the lower end of the wall components 30 and the peripheral edge of the bowl 24 to provide an absolute water tight joint between the bowl or bottom 24 and the vertical wall 14. While it is preferred that the silicone 46 fill the recess 32 to the bottom edge 33, such complete filling is not always necessary, it being intended that the silicone 46 be at sufficient depth in conjunction with the inclined wall 36 and the bowl wall 27 to structurally anchor flange 28 in the recess 32.

Figure 4:
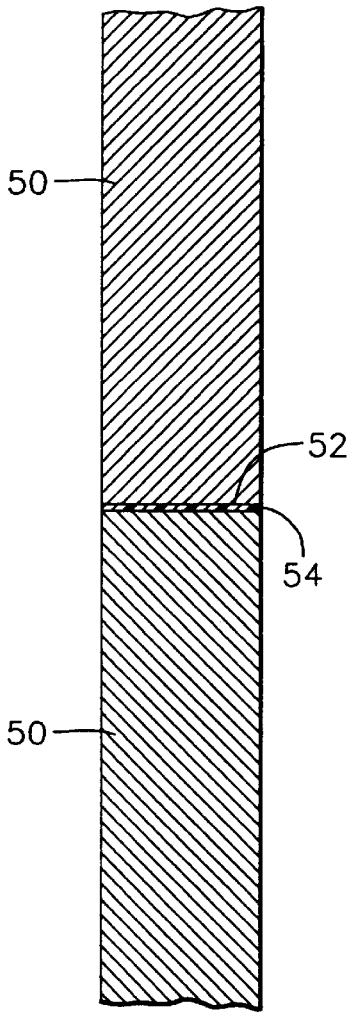
FIG. 4 (PRIOR ART)
FIG. 4 is a sectional view similar to FIG. 2 but illustrating prior art sink structure.

FIG. 4 illustrates a prior art joint between the vertical wall components 50 which are provided with a butt joint 52 in which the joining edges are straight and planar and the edges are joined by a two part adhesive and sealant 54. Thus, the structure as illustrated in FIG. 2 provides an additional mechanical and static stability by the tongue and groove connection and also includes an additional adhesive connection area around the periphery of the tongue 42 and the groove 40, respectively, as compared to the prior art structure shown in FIG. 4. Hence, the wall component interconnection of the present invention provides a more effective and permanent connection between the wall components 30 as compared to the prior art wall components 50.

Figure 5:
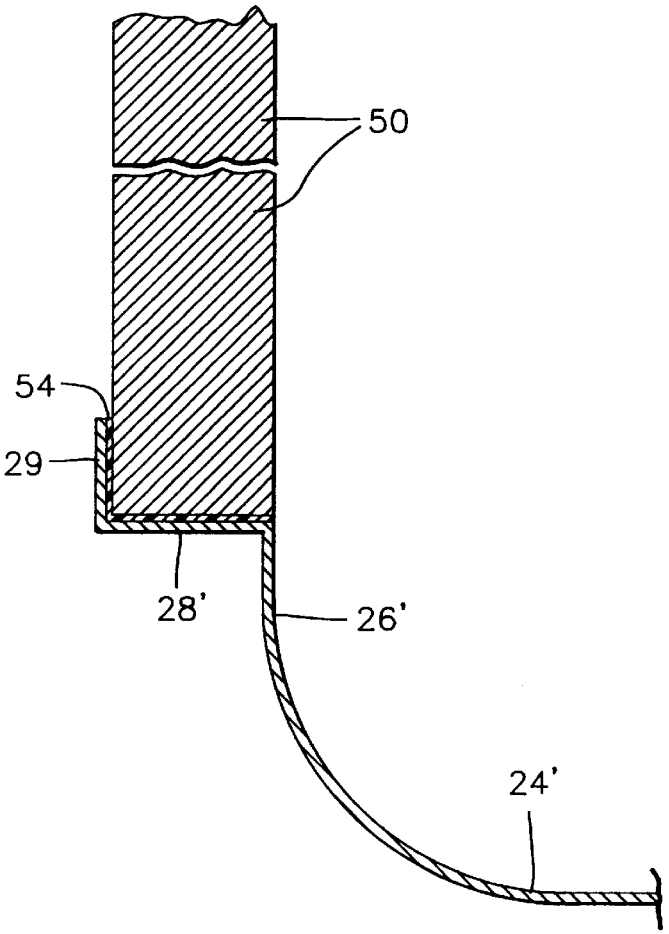
FIG. 5 (PRIOR ART)
FIG. 5 is a sectional view similar to FIG. 3 but illustrating prior art sink structure.

FIG. 5 illustrates a prior connection between a vertical wall component 50 and an upwardly curved peripheral wall 26' having a horizontal peripheral flange 28' on the upper edge and a vertical flange 29 at the outer edge of the flange 28'. The bottom edge of the vertical wall 50 engages the upper surface of the flange 28' and the inner surface of the upstanding flange 29. An adhesive and sealant 54 is provided between the engaging surfaces of the flanges 28' and 29 and the bottom edge of the wall 50 and a portion of the outer wall surface of the wall 50 adjacent its bottom edge. The adhesive and sealant 54 retains and seals the bottom bowl 24' with respect to the vertical wall 50. The manner of securing and sealing the bottom bowl 24 to the wall components 30, as illustrated in FIG. 3, provides a more effective mechanical connection and a more effective seal between the sink bottom 20 and the vertical wall 14.

As illustrated in FIG. 2, the upper outer surface of the vertical wall 14 is provided with a plurality of lateral outwardly extending reinforcement or support members 31 which are secured to the wall 14 and underlie, engage and reinforce the counter top 12 adjacent opening 16. The counter top 12 is secured to both the top edge of the vertical wall 14 and the reinforcement members 31 which extend at least partially throughout the length of each side of vertical wall 14 but do not extend completely around the periphery of the vertical wall 14. The support members 31 thus provide increased stability when the vertical wall and sink are undermounted in relation to the polymer based sheet material of the counter top 12.

When assembling the sink of the present invention with a counter top in which the counter top 12 and vertical walls 14 are constructed of the same thermoplastic solid surface sheet material, such as CORIAN® sheet material, the wall components 30 of the vertical wall 14 are first cut with a circular saw or the like from the solid sheet material in the prescribed rectangular sizes. The abutting side edges are routed to form the tongue 42 and groove 40, and the recess 32 is routed in the bottom edge 33 such that the recess outer wall 36 is sloped or inclined, preferably about 7°. The wall components are shaped as necessary to form the prescribed corners in the wall 14. The side edges of the wall components 30 are preferably first sanded or abraded and then assembled by applying a suitable sealant 38 to the abutting edges, tongue 42 and groove 40. If desired, these areas can first be prepared with a primer. Once the vertical wall 14 has been formed by sealing together the side edges of the wall components 30, the lateral outwardly extending reinforcement or support members 31 are secured to the top edge of the wall 14. Preferably, the support members 31 span the adhered side edges of wall components 30 to provide reinforcement for the vertical joints or seams at the upper edge of the wall assembly.

The wall assembly 14 is then inverted with the bottom edge 33 uppermost for assembly of the bottom or bowl 24 of stainless steel or the like. The top surface area of the flange 28 is preferably sanded or roughened, such as by use of a grinding lathe, to abrade the surface in order to provide a better adhesion with the adhesive and sealant material 44. The areas to be glued including the flange 28 on the stainless bottom and the recess 32 in the side wall components 30 are preferably first prepared with a primer. After drying of the primer, the flange 28 on the stainless steel bottom 20 and the recess 32 in the vertical wall components 30 are glued together with a suitable adhesive and sealant material. When polymerization or drying of the adhesive and sealant between the top surface of flange 28 and the upper wall of recess 32 is finished, the remainder of the recess is then filled with a self-leveling silicone 46. After polymerization/drying of the silicone, the connection of the flange 28 in the recess 32 serves as a reinforcement for the vertical joints or seams between the wall components 30 at the lower edge of the wall assembly. Further, the overall sink assembly is now ready to be undermounted in the opening in the counter top 12.

The areas to be glued or secured by adhesive in accordance with the present invention are preferably first prepared by the application of a primer for the adhesive with the primer being a solvent containing primer with a silicone resin base. The surfaces to be bonded must be dry, free of dust, grease and other contaminants. A cleaner may be used prior to application of the bonding materials, and an optimum bonding surface is achieved by means of roughening or sand blasting the surfaces. After the surfaces to be glued have been primed and after the primer has dried, the surfaces to be glued, including the vertical wall components and the stainless steel bottom, are glued together with a self-leveling silicone sealant/adhesive on the base of a solvent free acetic acid cross-linking silicone rubber which cures at room temperature, and under the influence of humidity becomes a permanently flexible material. The curing starts first on the surface of the silicone and creates a dry skin after a few minutes. The deep curing of the silicone rubber is effected at a speed of approximately 2 mm/24 hrs. In accordance with the present invention, when utilizing CORIAN® sheet material for the counter top 12 and the vertical wall 14, with a stainless steel bottom or bowl 24, a suitable solvent-containing primer with a silicone resin base is DELO-PRE® 3003 marketed by DELO Industrieklebstoffe GmbH & Co. KG of Landsberg, Germany. A suitable adhesive/sealant is DELO-GUM® 2301, also marketed by DELO Industrieklebstoffe GmbH & Co. KG.

When polymerization/drying of the adhesive between the top surface of the flange 28 and the upper horizontal surface of the recess 32 is finished, the unfilled portion of the recess having the inclined slope on the outer wall 36 is filled with self-leveling silicone similar to the silicone adhesive previously discussed but which is distinguished by a very high temperature resistance. The self-leveling silicone sealant/adhesive cures at room temperature and under influence of humidity becomes a permanently flexible material and the curing of the high temperature resistant silicone rubber is under the same conditions as the adhesive material. When polymerization is completed, the specific silicone in the groove or recess acts as a stamped rubber seal ensuring absolute water tightness. A particularly suitable silicone for filling the recess in accordance with the present invention is also marketed by DELO Industrieklebstoffe GmbH & Co. KG under the name DELO-GUM® 2301-WS.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A sink construction comprising a counter top having an opening therein, a vertical wall extending downwardly from an undersurface of said counter top at the periphery of said opening, a sink bowl underlying and supported from a lower inner edge of said vertical wall, said vertical wall including a downwardly and inwardly opening recess in said lower inner edge, said sink bowl including an upwardly extending peripheral wall having an outwardly extending flange along an upper edge thereof, said flange being received in said recess, an adhesive sealant between the flange and a downwardly facing wall of the recess, and an adhesive sealant filling at least a portion of said recess below said flange.

2. The sink construction as defined in claim 1 wherein the downwardly facing top wall of the recess is roughened and provided with a primer that is dry beneath the adhesive sealant.

3. The sink construction as defined in claim 2 wherein said counter top and vertical wall are constructed from a polymer based solid surface sheet material, and said sink bowl is constructed of stainless steel.

4. A sink construction comprising a counter top having an opening therein, a vertical wall depending from a periphery of said opening, a sink bowl underlying and supported from a lower edge of said vertical wall, said vertical wall including a downwardly and inwardly opening recess in said lower edge, said sink bowl including an upwardly extending peripheral wall having an outwardly extending flange along an upper edge thereof, said flange being received in said recess, an adhesive sealant between the flange and a downwardly facing wall of the recess, an adhesive sealant filling at least a portion of said recess below said flange, said recess including an outer wall, said adhesive sealant in the recess below said flange being sandwiched between said outer wall of the recess and said upper edge of the upwardly extending peripheral wall of the sink bowl.

5. The sink construction as defined in claim 4 wherein said outer wall of said recess is inclined inwardly to form a wedging surface engaging the adhesive sealant in the recess below the flange.

6. A sink construction comprising a counter tot having an opening therein, a vertical wall depending from a periphery of said opening, sink bowl underlying and supported from a lower edge of said vertical wall, said vertical wall including a downwardly and inwardly opening recess in said lower edge, said sink bowl including an outwardly extending flange along an upper edge thereof, said flange being received in said recess, and adhesive sealant securing said flange in said recess and filling at last a portion of said recess below said flange, said vertical wall being defined by a pair of components each defining one half of the vertical wall, a vertical seam connecting the adjacent edges of the vertical wall components, said vertical seam including a vertical tongue and groove connection with adhesive material bonding the periphery of the tongue and groove connection to provide static and mechanical stability and an increased adhesive surface area on the vertical seam.

7. The sink construction as defined in claim 6 and further including laterally extending support members at upper outer edge portions of said vertical wall for engagement with the undersurface of the counter top and which span said vertical seam connecting the adjacent edges of the vertical wall components in order to reinforce the vertical seam and the connection between the vertical wall and counter top.

8. The sink construction as defined in claim 6 wherein said recess includes an outer wall slanted downwardly and inwardly to form a wedging surface engaging the adhesive sealant filling the recess below the flange.

9. A sink construction comprising a counter top having an opening therein, a vertical wall depending from a periphery of said opening, a sink howl underlying and supported from a lower edge of said vertical wall, said vertical wall including a downwardly and inwardly opening recess in said lower edge, said sink bowl including an outwardly extending flange along an upper edge thereof, said flange being received in said recess, and adhesive sealant securing said flange in said recess and filling at least a portion of said recess below said flange, said vertical wall including laterally extending support members at upper outer edge portions thereof for engagement with the undersurface of the counter top to reinforce the connection between the vertical wall and counter top.

10. The sink construction as defined in claim 9 wherein said recess includes an outer wall slanted downwardly and inwardly to form a wedging surface engaging the adhesive sealant filling the recess below the flange.

11. A sink construction having a sink side wall and a sink bottom comprising a vertical wall forming a substantial portion of said sink side wall and attached adjacent a top edge of said vertical wall around an opening in a counter top, a sink bowl forming said sink bottom supported from a lower edge of said vertical wall, said lower edge including a downwardly and inwardly opening recess, said sink bowl including an upwardly extending peripheral wall having an outwardly extending flange along an upper edge thereof, said flange received in said recess, and an adhesive sealant between said flange and said recess filling at least a portion of said recess below said flange and engaging an outer surface of said upwardly extending peripheral wall of said sink bowl to secure said flange in said recess.

12. A sink construction as described in claim 11, wherein said recess and said flange are continuous about a periphery of said vertical wall and said sink bowl.

13. A sink construction as described in claim 11, wherein said recess includes an outer wall that is inclined inwardly to form a wedging surface engaging the adhesive sealant in the recess below the flange.

14. A sink as described in claim 13, wherein said outer wall is inclined from vertical toward said sink bowl in the range of 5 degrees to 30 degrees.

15. A sink as described in claim 14, wherein outer wall is inclined from vertical at approximately 7 degrees.

16. A sink construction as described in claim 11, wherein said vertical wall is defined by a pair of components each defining one half of the vertical wall, a generally vertical seam connecting adjacent edges of said vertical wall components, said seam including a vertical tongue and groove connection with adhesive material bonding the abutting edges.

17. A sink construction as described in claim 11, wherein said vertical wall includes at least one vertical seam, said seam connecting adjacent edges of said vertical wall, said vertical seam having a tongue and groove connection with adhesive material bonding abutting edges.

18. A sink construction as described in claim 17, further comprising laterally extending support members at upper outer edge portions of said vertical wall for engagement with the undersurface of said counter top and which span said vertical seam to reinforce said seam and the attachment between said vertical wall and said counter top.

19. A sink construction as claimed in claim 11, wherein said vertical wall includes laterally extending support members at upper outer edge portions thereof for engagement with the undersurface of said counter top to reinforce the connection between said vertical wall and said counter top.

20. A sink construction as described in claim 11 wherein said recess includes an outer wall and said adhesive sealant in the recess below said flange is sandwiched between said outer wall of said recess and an upwardly extending peripheral wall of said sink bowl.

* * * * *